US009875595B2

(12) United States Patent
Coutinho et al.

(10) Patent No.: US 9,875,595 B2
(45) Date of Patent: Jan. 23, 2018

(54) COIN SERIALIZER WITH FILTER DISK FOR FILTERING DEBRIS AND FOREIGN OBJECTS

(71) Applicant: Cata Company, Pompano Beah, FL (US)

(72) Inventors: Deivid Henrique Coutinho, Florianópolis (BR); Vilmar Claudino Dos Santos Filho, Florianópolis (BR); Felipe Eugênio Dutra, Florianópolis (BR); Cristiano Scheidt Manoel, Florianópolis (BR)

(73) Assignee: Cata Company, Pompano Beach, FL (US)

( * ) Notice: Subject to any disclaimer, the term of this patent is extended or adjusted under 35 U.S.C. 154(b) by 0 days.

(21) Appl. No.: 15/512,926

(22) PCT Filed: Sep. 15, 2016

(86) PCT No.: PCT/US2016/051831

§ 371 (c)(1),
(2) Date: Mar. 21, 2017

(87) PCT Pub. No.: WO2017/048894

PCT Pub. Date: Mar. 23, 2017

(65) Prior Publication Data

US 2017/0294067 A1 Oct. 12, 2017

(30) Foreign Application Priority Data

Sep. 18, 2015 (BR) ..... 102015024148

(51) Int. Cl.

| | |
|---|---|
| ***G07D 9/06*** | (2006.01) |
| ***G07D 9/00*** | (2006.01) |
| ***G07D 3/14*** | (2006.01) |
| ***G07D 3/16*** | (2006.01) |
| ***G07F 1/04*** | (2006.01) |

(52) U.S. Cl.
CPC ..... *G07D 9/008* (2013.01); *G07D 3/14* (2013.01); *G07D 3/16* (2013.01); *G07D 9/06* (2013.01); *G07F 1/04* (2013.01)

(58) Field of Classification Search
CPC .. G07D 1/00; G07D 9/00; G07D 9/06; G07D 9/008; G07F 1/04
See application file for complete search history.

(56) References Cited

U.S. PATENT DOCUMENTS

| | | | | |
|---|---|---|---|---|
| 5,868,614 | A * | 2/1999 | Hirano | G07D 9/008 453/57 |
| 2002/0170801 | A1 | 11/2002 | Martin | |
| 2004/0097182 | A1 | 5/2004 | Hill et al. | |
| 2008/0039004 | A1 * | 2/2008 | String | G07D 9/008 453/57 |
| 2009/0305620 | A1 * | 12/2009 | Hino | G07D 3/06 453/5 |
| 2012/0231719 | A1 | 9/2012 | Starke et al. | |

* cited by examiner

*Primary Examiner* — Mark Beauchaine
(74) *Attorney, Agent, or Firm* — Coats & Bennett, PLLC

(57) ABSTRACT

A filter disk filters coins deposited into coin machines for counting, sorting, separating or processing coins to prevent the introduction or entry of foreign objects and debris into the coin machine, thus protecting and ensuring the proper functioning of the machine.

16 Claims, 8 Drawing Sheets

COIN SERIALIZER WITH FILTER DISK FOR FILTERING DEBRIS AND FOREIGN OBJECTS

RELATED APPLICATIONS

This application claims priority to Brazilian Patent Application Serial Number 10 2015 024148 8 filed Sep. 18, 2015, the entire contents of which are incorporated herein by reference.

TECHNICAL FIELD

The present disclosure relates generally to coin machines and, more particularly to a filter disk for separating debris and foreign objects from coins deposited into the coin machine.

BACKGROUND

The present patent application relates to a filter disk for filtering coins whose purpose it is to separate foreign objects from coins. The filter disk comprises a fixed disc with holes and slots with the ability to prevent the introduction or entry of objects that are not coins into machines for counting, sorting, separating or processing coins, thus protecting and ensuring the proper functioning of the machine. The filter disk is intended for use in a self-service machine of the type for the general public, preferably for a coin counting machine as described by the patent filed on Mar. 21, 2012 with the Brazilian National Industrial Property Institute [INPI] under the number BR 1020120062984.

In the current state of the art, users usually empty their personal containers, such as old cans or bottles or piggy banks, directly into the coin machine without first checking whether the contents only include coins. Buttons, medallions, screws, balls and various other objects will therefore likely be present with the coins in the machine. Consequently, it is necessary for a debris filter to be disposed at the inlet of the coin machine in order to ensure that the coin machine is not damaged during use. U.S. Pat. No. 5,564,546 issued on Oct. 15, 1996 describes filtering by means of a funnel-type conical tray. The lower portion of the funnel is perforated, thus enabling small foreign objects to exit the funnel through these holes and allowing only the coins to pass through to the next step. Once the coins are in the funnel, the user has the opportunity to remove large foreign objects. After inspecting the coins, the user presses the "Go" button, thus indicating that he would like to use the machine, upon which the edge of the articulated tray is raised, causing the coins to fall into a chute. When the "Go" button is pressed, the coin counter is started up, and a blower on the interior of the chute is activated. The blower blows light debris, such as lint and dust, out of the chute and away from the coin counting/sorting mechanism. The surface of the bottom of the chute is a plate with slots and holes that allows any loose fluids to be removed from the coins and collected, which helps prevent possible damage to the machine. Magnetic strips are disposed placed affixed along the areas of the inlet and outlet entrance and exit of the chute in order to remove any magnetic objects that may be included among the coins.

Manufacturers of coin counting equipment, such as Hess, ScanCoin, EccosTecno (Gerbô), Pentasis, and WR do Brasil have equipment with their own mechanisms for preventing the introduction of foreign objects into their machines. Their machines have simple mechanisms, since they are intended for use in the office or back-office and not by the general public as a self-serve machine for consumers.

SUMMARY

The present disclosure relates to a filter disk for filtering coins deposited into coin machines for counting, sorting, separating or processing coins to prevent the introduction or entry of objects that are not coins into the coin machines, thus protecting and ensuring the proper functioning of the machine. The filter disk is intended for self-service coin machines of the type for the general public, such as the coin counting machine described by the patent filed on Mar. 21, 2012 with the Brazilian National Industrial Property Institute [INPI] under the number BR 1020120062984. The filter disk includes a series of slots and holes that are sized and arranged to allow foreign objects and debris smaller than the coins to pass through the filter disk. Thus, foreign objects and debris may be separated from the coins.

One exemplary embodiment of the disclosure comprises a coin serializer for a coin machine including a filter disk to separate foreign objects and debris from coins deposited into the coin machine. A receiving unit in the coin serializer includes a coin outlet for discharging coins from the coin serializer and at least one debris outlet for discharging foreign objects and debris from the coin serializer. A rotating disk is rotatably mounted to the receiving unit to serialize coins deposited in the coin machine and transport coins one at a time to the coin outlet. The rotating disk comprises a plurality of coin openings in which the coins are received. The filter disk is disposed between the rotating disk and the receiving unit. The filter disk comprises a coin slot sized and arranged to allow coins to pass through the filter disk and exit the coin serializer through the coin outlet, and at least one set of filter slots sized to allow foreign objects and debris smaller than coins to pass through the filter disk. The filter slots are arranged so that the coin openings in the rotating disk pass over the filter slots as the rotating disk rotates to filter foreign objects and debris.

Another embodiment of the disclosure comprises a filter disk for a coin machine. The filter disk comprises a flat, annular plate having a central opening and an outer periphery. A coin slot is formed in the annular plate and is sized and arranged to allow coins deposited into the coin machine to pass through the filter disk. A first set of circumferentially spaced filter slots is formed in the outer periphery of the filter disk and are sized to allow foreign objects and debris smaller than coins to pass through the filter disk. A second set of parallel, arcuate shaped filter slots are formed in the annular plate and extend between the central opening of the filter disk and the outer periphery of the filter disk. The second set of filter slots are likewise sized to allow foreign objects and debris smaller than coins to pass through the filter disk.

Another exemplary embodiment of the disclosure comprises a coin machine incorporating the filter disk as described above.

Another exemplary embodiment of the disclosure comprises a coin machine incorporating the coin serializer as described above.

DETAILED DESCRIPTION

Figure 1:
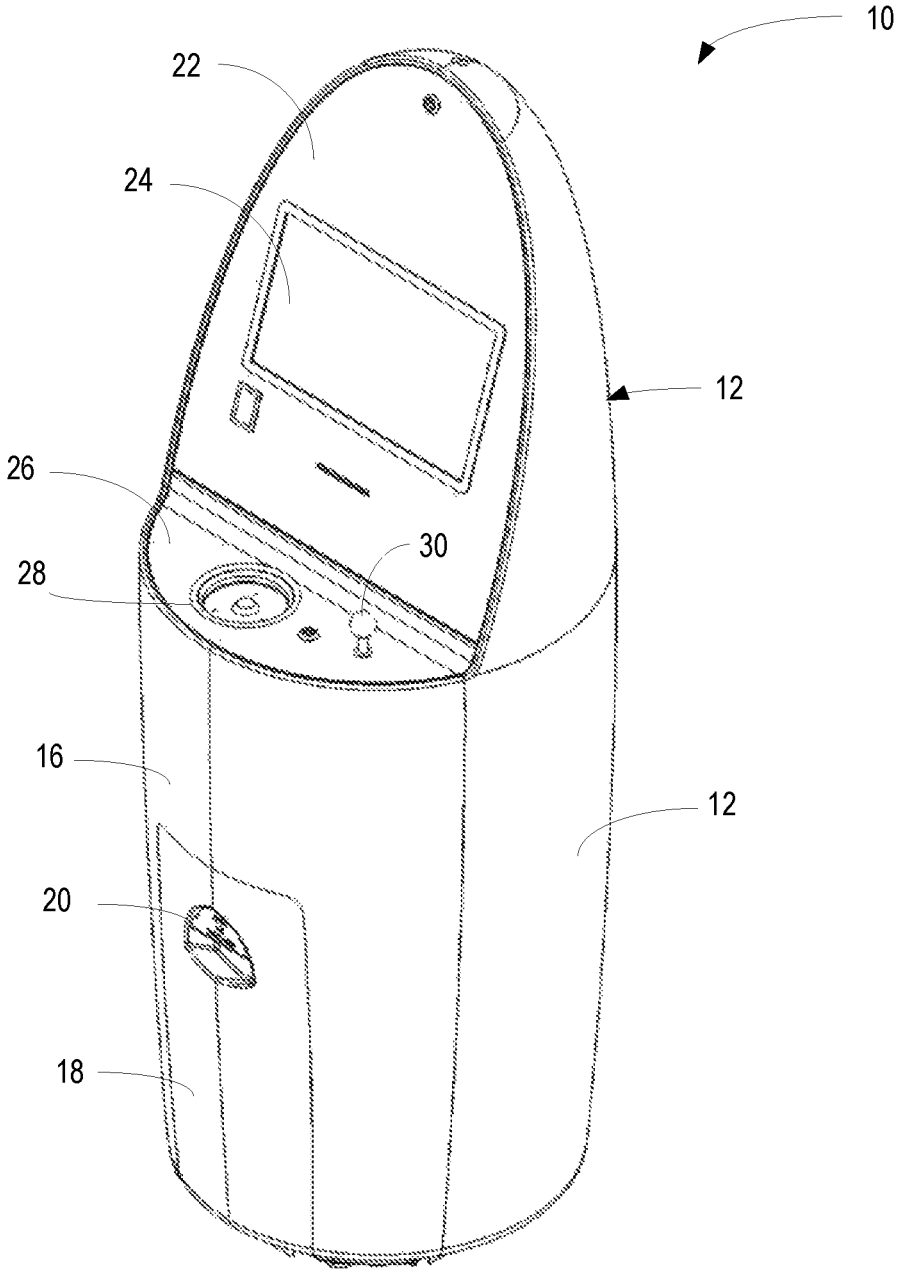
FIG. 1 is a perspective view of a coin machine including a filter disk for separating debris and foreign objects from coins deposited into the coin machine.
Figure 2:
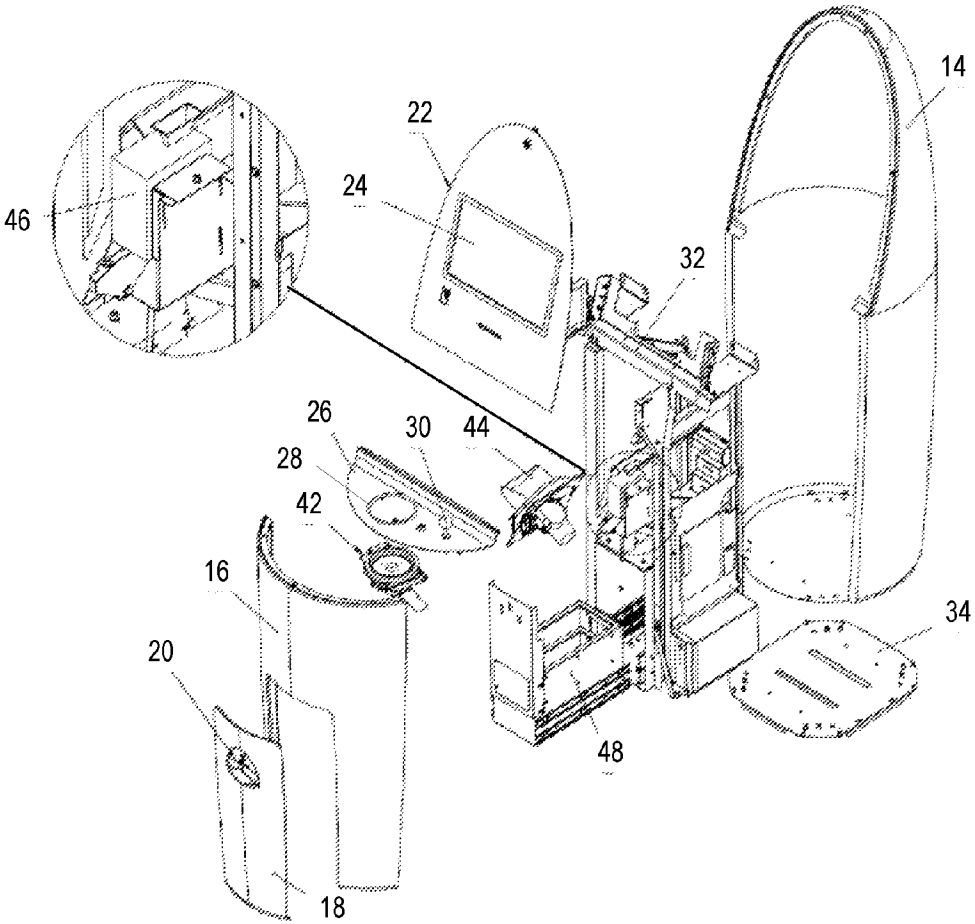
FIG. 2 is an exploded perspective view of the coin machine.

Referring now to the drawings, FIGS. 1 and 2 illustrate an exemplary coin machine 10 according to one embodiment. The main components on the coin machine 10 comprise a housing 12, an internal frame structure 32, a coin disk filter 42, a coin serializer 44, a coin validator 46, and a drawer safe 48.

The housing 12 comprises a rear housing section 14, a front housing section 16, a front panel 22, and a console 26. The rear housing section 14 and front housing section 16 may be constructed of plastic, metal, or other suitable material. The front housing section 16 connects to the lower portion of the rear housing section 14. The front housing section 16 includes a door 18 for accessing the drawer safe 48 contained within the housing 12 and a coin reject slot 20 through which coins rejected by the coin machine are returned to the user. The front panel 22 attaches to the upper portion of the rear housing section 14 and includes a touch screen display 24 to receive user input and display information to the user. The main console 26 attaches to the upper end of the front housing section 16. The main console 26 includes an opening 28 through which coins are received into the coin machine 10. As will be hereinafter described in greater detail, the coin disk filter 42 is affixed to the main console 26 and is disposed immediately below the coin opening 28 to receive coins deposited by a user. In some embodiments, a joy stick 30 may be affixed to the main console 26 to allow users to interact with the coin machine and/or play games while coins are being counted.

An internal frame structure 32 is contained within the housing 12. To prevent theft of the coin machine 10, the rear housing section 14 and internal frame 32 are affixed to a base plate 34 that can be bolted or otherwise secured to the floor. The frame 32 may also include attachment points for attaching the rear housing section 14 and front housing section 16.

The main components of the coin machine 10 involved in processing coins comprise the coin disk filter 42, coin serializer 44, coin validator 46, and drawer safe 48. The coin disk filter 42, as previously described, affixes to the console 26 and is disposed below the opening 28 to receive coins that are being exchanged. The main function of the coin disk filter 42 is to separate coins from larger objects and direct the flow of coins to the coin serializer 44. The coin serializer 44 receives coins from the coin disk filter 42. The main functions of the coin serializer 44 are to serialize the coins input to the coin machine 10 and to filter smaller objects or coins of different metals. The coin validator 46 receives the coins from the coin serializer 42 and validates the coins. Coins may be either accepted or rejected by the coin validator. Coins that are accepted are directed into the drawer safe 48, which stores the coins until they are collected. Coins that are rejected are directed to the reject slot 20 in the door 18 on the front cover 16. The coin validator 46 communicates with the control system 100 of the coin machine 10, which keeps a count of the amount of money deposited into the coin machine 10.

Figure 3:
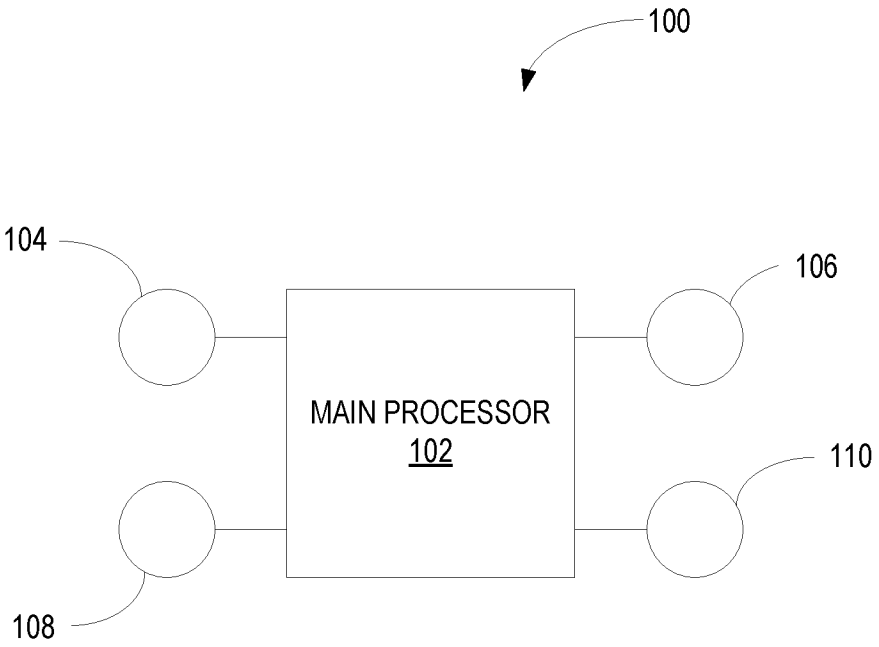
FIG. 3 is a block diagram of a control system for the coin machine.
Figure 4:
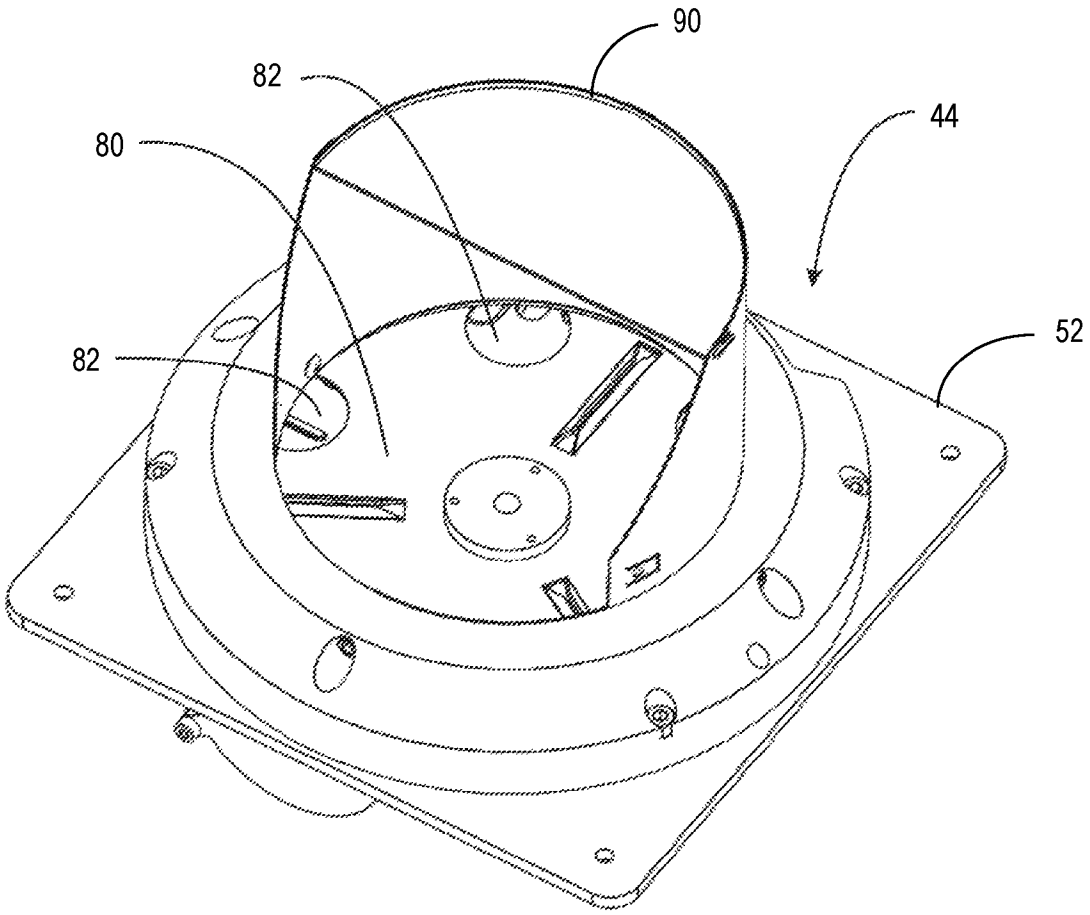
FIG. 4 is a perspective view of a coin serializer for the coin machine with a hopper installed.
Figure 5:
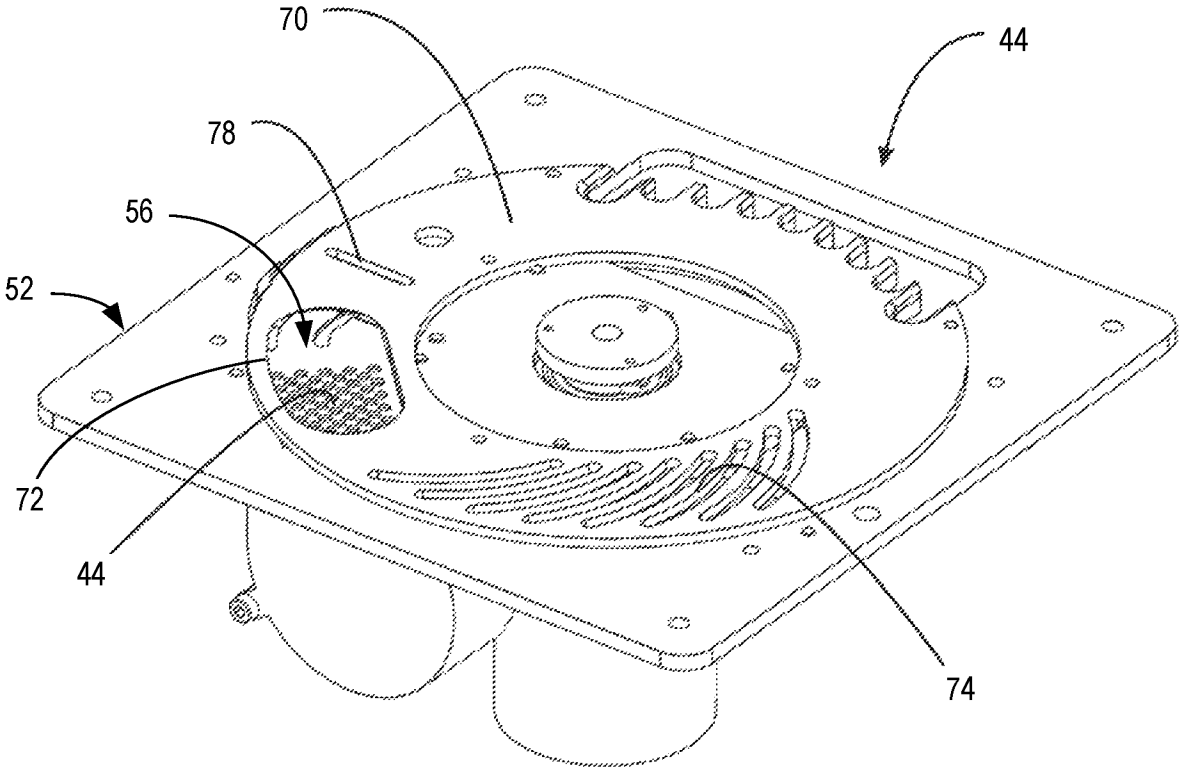
FIG. 5 is a perspective view of a coin serializer for the coin machine with the hopper removed.

The control system 100, shown schematically in FIG. 3, comprises a main processor 102 that receives input from the coin validator 46 and various sensors, controls the operation of the coin machine 10, and performs the accounting functions. When a user deposits coins into the coin machine 10, the main processor 102 receives an input signal from a presence sensor 104 indicating the presence of coins in the coin disk filter 42 and activates the coin disk filter motor 106. An encoder (not shown) associated with the motor 106 provides feedback to the main processor 102 indicating that the coin disk filter 42 is spinning. In response to input from the presence sensor 104 and encoder, the main processor 102 activates a solenoid (not shown) to open the coin entrance door in the coin disk filter 42. When the coin entrance door is open, the coins are directed to the coin serializer 44.

A second presence sensor 108 in the coin serializer 44 indicates when coins are present in the coin serializer 44. Upon detection of coins in the coin serializer 44, the main processor 102 activates a motor 110 for the coin serializer 44. As previously described the coin serializer 44 filters foreign objects and debris and passes the coins one at a time to the coin validator 46.

The coin validator 46 validates coins and separates coins of different type. The coin validator 46 provides input to the main processor 102 indicating the number of validated coins of different types. The main processor 102 includes an accounting function to keep account of the value of the coins deposited into the coin machine 10. When the user has finished depositing coins, the main processor 102 issues a receipt for the deposit. In addition, the main processor 102 may enable the user to apply the amount of the deposit towards coupons, vouchers, donations to charity, pre-paid cell phone accounts, and other services that can be aggravated through the software.

FIGS. 4-10 illustrate the coin serializer 44 in more detail. The coin serializer 44 generally comprises a fixation base 52, a filter disk 70, a rotating disk 80, and a hopper 90. The rotating disk 80 is rotatably mounted to the fixation base 52. The filter disk 70 is disposed between the rotating disk 80 and the fixation base 52. The hopper 90 mounts on the fixation base 52 and partially encloses the rotating disk 80 and filter disk 70. The main function of the hopper 90 is to funnel coins from the coin disk filter 42 to the coin serializer 44. Coins deposited into the coin machine 10 are directed from the coin disk filter 42 into the hopper 90, where the coins are stored until being processed by the coin serializer 44.

Figure 6:
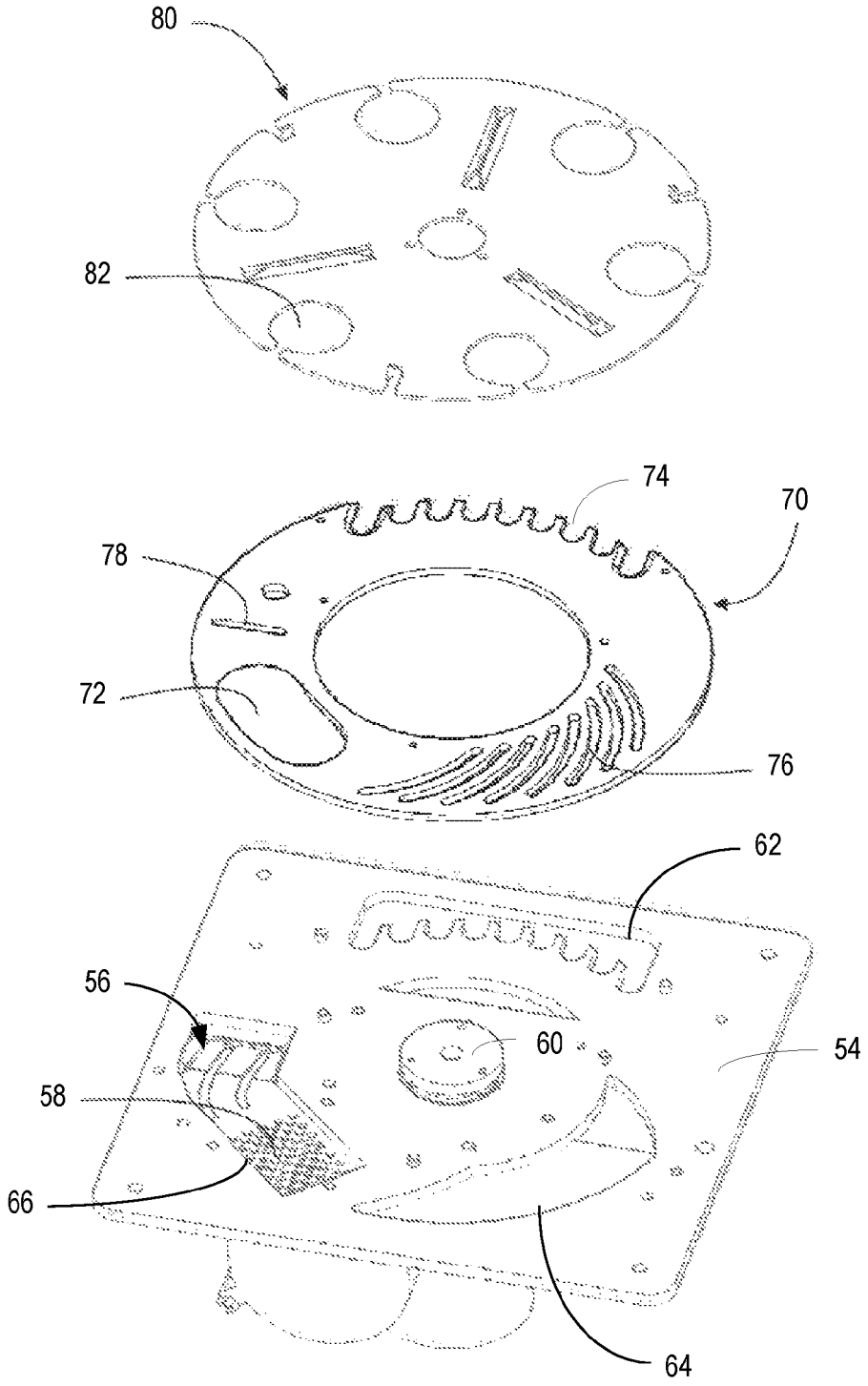
FIG. 6 is an exploded perspective view of the coin serializer showing the filter disk.
Figure 7:
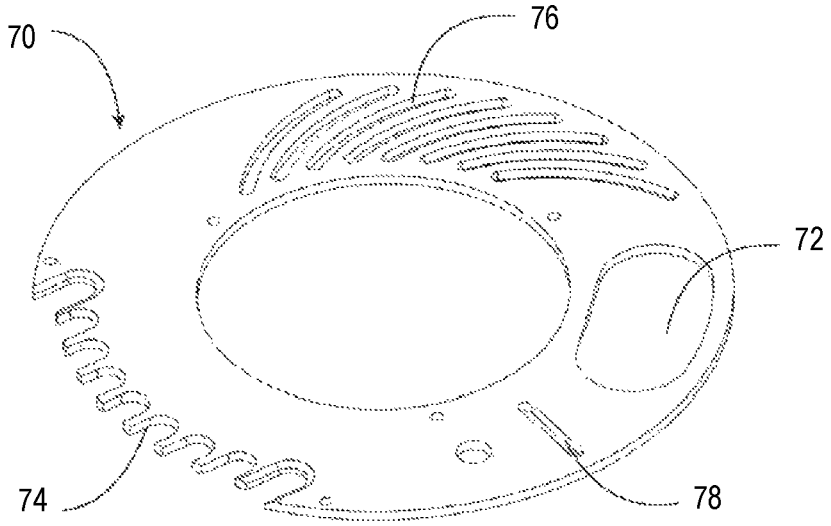
FIG. 7 is a perspective view of the filter disk for the coin serializer.
Figure 8:
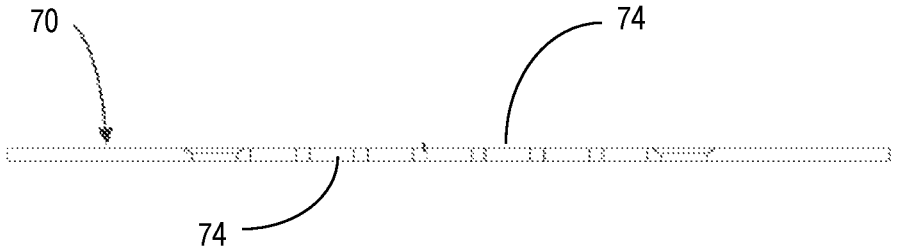
FIG. 8 is a side view of the filter disk for the coin serializer.
Figure 9:
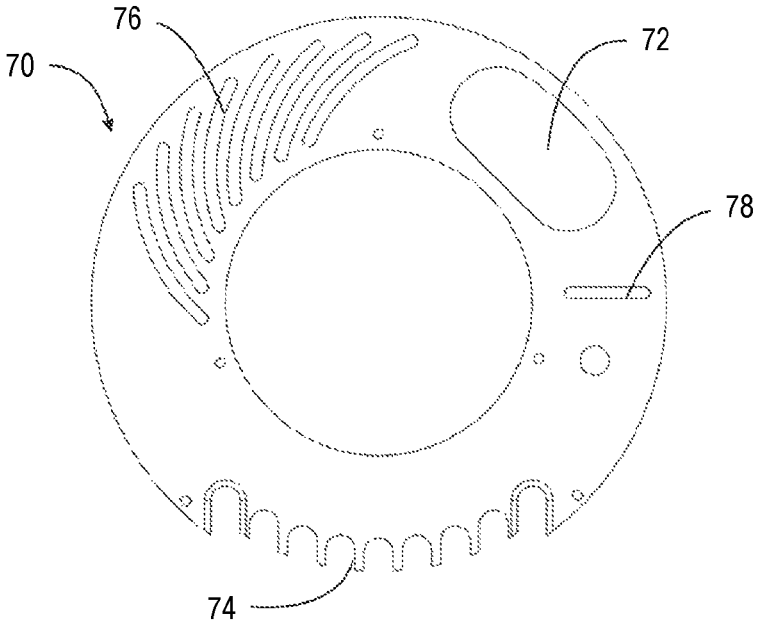
FIG. 9 is a top plan view of the filter disk for the coin serializer.
Figure 10:
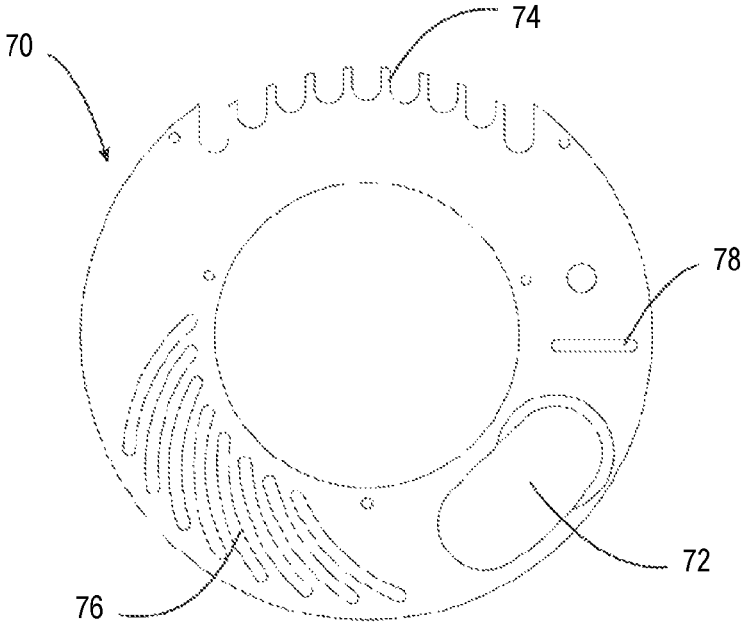
FIG. 10 is a bottom plan view of the filter disk for the coin serializer.

The fixation base 52, shown best in FIG. 6, includes a generally flat base plate 54 having a coin outlet 66 formed therein to discharge coins one at a time. A coin chute 56 affixes to the base plate 54 and is arranged so that coins fall through the coin outlet 66 into the coin chute 56. The bottom of the coin chute 56 may include openings 58 to allow dust and other small particles to fall by gravity out of the coin chute 56. Coins falling into the coin chute 56 slide by gravity along the coin chute 56 and are directed to the coin validator 46. The base plate 54 further includes debris outlets 62, 64, as described in more detail below, to receive foreign objects and debris that are separated from the coins by the coin serializer. Debris chutes (not shown) may be affixed to the base plate 54 to direct the foreign objects and debris to a collection area.

The motor 110 for the coin serializer 44 is affixed to the underside of the base plate 54. A drive member 60 connects to an output shaft of the motor 110. As will be described in more detail below, the motor 110 is operative to rotate the rotating disk 80 when activated by the main processor 102, i.e. when coins are present in the coin serializer 44. The motor 110 normally rotates clockwise during operation, but can also be rotated counter-clockwise in case coins get jammed to free any jammed coins.

The filter disk 70, shown in FIGS. 7-10, comprises an annular plate having a central opening and an outer periphery. The annular plate may, for example, be made of ultra-high molecular weight polyethylene (UHMW), a high-performance polymer that allows coins to easily slide along its surface. The filter disk is affixed to the top side of the base plate 54 on the fixation base 52. The filter disk 70 includes an oblong-shaped coin slot 72 that aligns with the coin outlet 66 in the base plate 54. The filter disk 70 further includes two sets of filter slots: the primary filter slots 74 and secondary filter slots 76. The filter slots 74 and 76 are sized so that foreign objects less than a pre-determined size will pass through the filter slots. The primary filter slots 74 are located along the outer periphery of the filter disk 70. The primary filter slots 74 generally comprise u-shaped slot extending inward from an outer periphery of the filter disk 70 and separated by serrations on the outer periphery of the filter disk 70. The secondary filter slots 76 are located between the primary filter slots and the coin slot 72. The secondary filter slots 76 comprise a series of parallel, arcuate shaped slots formed in the annular plate. The secondary filter slots 76 extend between the central opening of the filter disk and the outer periphery of the filter disk. The length of the secondary filter slots 76 is greater than a diameter of the largest coin that can be accepted by the coin machine. As will be described in more detail below, the filter slots 74 and 76 successively filter foreign objects and debris to separate the coins before the coins are discharged from the coin serializer 44.

The filter disk 70 further includes a slot 78 that is engaged by a hook-like element (not shown) on the coin chute 56.

The rotating disk 80 rotatably mounts to the drive member 66 on the fixation base 52. The rotating disk 80 has a series of coin openings 82 circumferentially spaced along the outer circumference of the rotating disk 80. When the presence of coins in the coin serializer 44 is detected, the main processor 102 activates the motor 106 for the coin serializer 44 to rotate the rotating disk 80. The coins input to the coin serializer 44 fit in the openings of the rotating disk 80, which transports the coins to the coin slot 82 in the filter disk 80. While the rotating disk 80 is rotating, the coin openings 82 will successively pass over the filter slots 84 and 86 in the filtration disk 80. The filter slots 84 and 86 are sized so that the coins will not fall through the filter slots 84, 86. However, foreign objects and debris picked up in the coin openings 82 may pass through the filter slots 84 and 86. Thus, small objects collected in the coin openings 82 are allowed to fall through the filter slots 74, 76 in the filter disc 70 before the coin opening 82 passes over the coin slot 72. Therefore, foreign objects and debris may be separated from the coins. As the coin opening passes over the coin slot 72 in the filter disk 70, the coin falls through the coin slot 72 and into the coin chute 56.

What is claimed is:

1. A coin serializer for a coin machine comprising:

a receiving unit including a coin outlet for discharging coins from the coin serializer and at least one debris outlet for discharging foreign objects and debris from the coin serializer;

a rotating disk rotatably mounted to the receiving unit to serialize coins deposited in the coin machine and transport coins one at a time to the coin outlet, said rotating disk comprising a plurality of coin openings in which the coins are received; and a filter disk disposed between the rotating disk and the receiving unit, said filter disk comprising:

a coin slot sized and arranged to allow coins to pass through the filter disk and exit the coin serializer through the coin outlet; and at least one set of filter slots sized to allow foreign objects and debris smaller than coins to pass through the filter disk, said filter slots arranged so that the coin openings in the rotating disk pass over the filter slots as the rotating disk rotates.

2. The coin serializer of claim 1 wherein the filter disk includes a first set of circumferentially spaced filter slots formed in the outer periphery of the filter disk to allow foreign objects and debris to pass through the filter disk and exit the coin serializer through one of said debris outlets.

3. The coin serializer of any one of claim 1 wherein the coin slot has an arcuate, oblong shape that extends circumferentially around a center of the filter disk.

4. The coin serializer of claim 1 wherein the filter disk comprises a flat annular plate having a central opening and an outer periphery.

5. The coin serializer of claim 4 wherein the filter disk includes a second set of parallel, arcuate shaped filter slots extending between the central opening of the filter disk and the outer periphery of the filter disk to allow foreign objects and debris to pass through the filter disk and exit the coin serializer through one of said debris outlets.

6. A filter disk for a coin machine comprising:

a flat, annular plate having a central opening and an outer periphery;

a coin slot formed in the annular plate sized and arranged to allow coins deposited into the coin machine to pass through the filter disk; and a first set of circumferentially spaced filter slots formed in the outer periphery of the filter disk and sized to allow foreign objects and debris smaller than coins to pass through the filter disk;

a second set of parallel, arcuate shaped filter slots formed in the annular plate and extending between the central opening of the filter disk and the outer periphery of the filter disk, the second set of filter slots being sized to allow foreign objects and debris smaller than coins to pass through the filter disk.

7. The filter disk of claim 6 wherein the coin slot has an arcuate, oblong shape and extends circumferentially around a center of the filter disk.

8. The filter disk of claim 6 wherein a length of the arcuate shaped filter slots is greater than a diameter of the largest coin that can be accepted by the coin machine.

9. A coin machine comprising:

a housing;

a coin serializer disposed with the housing and configured to serialize coins deposited into the coin machine;

said coin serializer comprising:

a receiving unit including a coin outlet for discharging coins from the coin serializer and at least one debris outlet for discharging foreign objects and debris from the coin serializer;

a rotating disk rotatably mounted to the receiving unit to serialize coins deposited in the coin machine and transport coins one at a time to the coin outlet, said rotating disk comprising a plurality of coin openings in which the coins are received; and a filter disk disposed between the rotating disk and the receiving unit, said filter disk comprising:

a coin slot sized and arranged to allow coins to pass through the filter disk and exit the coin serializer through the coin outlet; and at least one set of filter slots sized to allow foreign objects and debris smaller than coins to pass through the filter disk, said filter slots arranged so that the coin openings in the rotating disk pass over the filter slots as the rotating disk rotates.

10. The coin machine of any one of claim 9 wherein the coin slot has an arcuate, oblong shape that extends circumferentially around a center of the filter disk.

11. The coin machine of claim 9 wherein the filter disk comprises a flat annular plate having a central opening and an outer periphery.

12. The coin machine of claim 11 wherein the filter disk includes a first set of circumferentially spaced filter slots formed in the outer periphery of the filter disk to allow foreign objects and debris to pass through the filter disk and exit the coin serializer through one of said debris outlets.

13. The coin machine of claim 12 wherein the filter disk includes a second set of parallel, arcuate shaped filter slots extending between the central opening of the filter disk and the outer periphery of the filter disk to allow foreign objects and debris to pass through the filter disk and exit the coin serializer through one of said debris outlets.

14. A coin machine comprising:

a housing;

a filter disk disposed within the housing to separate foreign objects from coins deposited into the coin machine;

said filer disk comprising:

a flat, annular plate having a central opening and an outer periphery;

a coin slot formed in the annular plate sized and arranged to allow coins deposited into the coin machine to pass through the filter disk; and a first set of circumferentially spaced filter slots formed in the outer periphery of the filter disk and sized to allow foreign objects and debris smaller than coins to pass through the filter disk;

a second set of parallel, arcuate shaped filter slots formed in the annular plate and extending between the central opening of the filter disk and the outer periphery of the filter disk, the second set of filter slots being sized to allow foreign objects and debris smaller than coins to pass through the filter disk.

15. The coin machine of claim 14 wherein the coin slot in the filter disk has an arcuate, oblong shape and extends circumferentially around a center of the filter disk.

16. The coin machine of claim 14 wherein a length of the arcuate shaped filter slots in the filter disk is greater than a diameter of the largest coin that can be accepted by the coin machine.

* * * * *